US005383792A

United States Patent [19]

Korsunsky et al.

[11] Patent Number: 5,383,792

[45] Date of Patent: * Jan. 24, 1995

[54] INSERTABLE LATCH MEANS FOR USE IN AN ELECTRICAL CONNECTOR

[75] Inventors: Iosif Korsunsky, Harrisburg; Richard C. Schroepfer, Thompsontown; Monte L. Kopp, Tower City, all of Pa.

[73] Assignee: The Whitaker Corporation, Wilmington, Del.

[ * ] Notice: The portion of the term of this patent subsequent to Jan. 22, 2008 has been disclaimed.

[21] Appl. No.: 26,280

[22] Filed: Mar. 4, 1993

Related U.S. Application Data

[63] Continuation of Ser. No. 645,151, Jan. 22, 1991, abandoned, which is a continuation of Ser. No. 313,261, Feb. 21, 1989, Pat. No. 4,986,765.

[51] Int. Cl.[6] ..... H01R 9/09

[52] U.S. Cl. ..... 439/326; 439/636; 439/856

[58] Field of Search ..... 439/326, 335, 629, 630, 439/634, 635, 636, 744, 756

[56] References Cited

U.S. PATENT DOCUMENTS

| | | | |
|---|---|---|---|
| 2,801,188 | 8/1957 | Badders . | |
| 2,825,037 | 2/1958 | French . | |
| 2,942,229 | 6/1960 | Berger . | |
| 3,149,897 | 9/1964 | Martineck . | |
| 3,246,279 | 4/1966 | Storcel . | |
| 3,270,313 | 8/1966 | Sautois . | |
| 3,297,974 | 1/1967 | Pittman . | |
| 3,711,816 | 1/1973 | Schumacher | 439/353 X |
| 3,718,895 | 2/1973 | Reynolds et al. | 339/258 |
| 3,784,955 | 1/1974 | Reynolds et al. | 339/17 |
| 3,803,533 | 4/1974 | Taplin | 339/91 |
| 3,885,849 | 5/1975 | Bailey et al. . | |
| 3,920,303 | 11/1975 | Pittman et al. | 439/326 |
| 3,926,499 | 12/1975 | Bailey et al. . | |
| 3,936,082 | 2/1976 | Swanson . | |
| 3,957,337 | 5/1976 | Damiano . | |
| 3,993,390 | 11/1976 | Eigenbrode . | |
| 4,018,494 | 4/1977 | Scheingold et al. . | |
| 4,046,450 | 9/1977 | Yurtin . | |
| 4,057,879 | 11/1977 | Eigenbrode . | |
| 4,069,558 | 1/1978 | Eberhart . | |
| 4,074,928 | 2/1978 | Johnston . | |

(List continued on next page.)

FOREIGN PATENT DOCUMENTS 0093510 11/1983 European Pat. Off. .

(List continued on next page.)

OTHER PUBLICATIONS

Search Report 85227US.

(List continued on next page.)

*Primary Examiner*—Z. R. Bilinsky
*Attorney, Agent, or Firm*—Bruce J. Wolstoncroft

[57] ABSTRACT

An electrical connector (2) has a dielectric housing with contact terminals (22) which extend therethrough. The contact terminals (22) are provided to electrically connect a mother board (4) to a daughter card (6). A board-receiving opening (20) is provided in the housing for reception of the daughter card (6) therein. Proximate to the board-receiving opening (20) are latch receiving openings (24) which are dimensioned to receive insertable latch members (40) therein. The latch members (40) are manufactured from material having the desired resilient and strength characteristics, thereby insuring that the latch members (40) will be effective over many cycles. Each latch member (40) has a resilient section (42) for cooperating with the daughter card (6) and a mounting section (44) for cooperating with the mother board (4). The resilient section (42) is able to accommodate a range of board sizes without taking a permanent set. If required the latch members (40) can have enhanced electrical characteristics so that the power and ground connections between the mother board (4) and the daughter card (6) can be made through the latch members (40).

55 Claims, 5 Drawing Sheets

U.S. PATENT DOCUMENTS 4,079,346 3/1978 Rys .
4,080,037 3/1978 Kunkle et al. ..... 339/258
4,082,400 4/1978 Gansert .
4,085,916 4/1978 Pedersen .
4,090,760 5/1978 Furey .
4,107,770 8/1978 Weber .
4,109,989 8/1978 Snyder, Jr. et al. .
4,113,179 9/1978 McKee .
4,129,351 12/1978 Sugimoto et al. ..... 439/630 X
4,136,917 1/1979 Then et al. .
4,145,103 3/1979 Knowles .
4,145,259 3/1979 Leumann .
4,146,762 3/1979 Peck et al. .
4,156,902 5/1979 Wandler .
4,188,083 2/1980 Knowles .
4,193,654 3/1980 Hughes et al. .
4,210,376 7/1980 Hughes et al. .
4,245,879 1/1981 Buck .
4,272,689 6/1981 Crosby et al. .
4,296,989 10/1981 Larson et al. .
4,307,359 12/1981 Schultz et al. .
4,330,163 5/1982 Aikens et al. .
4,335,816 6/1982 Rager .
4,354,720 10/1982 Bakermans .
4,362,353 12/1982 Cobaugh ..... 339/258
4,377,795 3/1983 Schultz et al. .
4,384,757 5/1983 Andrews et al. ..... 339/258
4,386,820 6/1983 Dola et al. .
4,399,371 8/1983 Ziff et al. .
4,422,678 12/1983 Tuckett et al. .
4,427,247 1/1984 Petersen .
4,433,888 2/1984 Winger .
4,439,971 4/1984 Rutherford .
4,477,132 10/1984 Moser et al. .
4,481,491 11/1984 Heft et al. .
4,504,105 3/1985 Barkus et al. .
4,521,063 6/1985 Mile .
4,528,728 7/1985 Schmidt et al. .
4,530,530 7/1985 Schaefer .
4,536,045 8/1985 Reichardt et al. .
4,550,362 10/1985 Reimer ..... 439/345 X
4,550,968 11/1985 Corrigan .
4,578,732 3/1986 Draper et al. .
4,579,411 4/1986 Cobaugh et al. .
4,583,810 4/1986 Gliha, Jr. .
4,585,122 4/1986 Stegenga .
4,585,288 4/1986 Aikens .
4,589,794 5/1986 Sugiura et al. .
4,621,885 11/1986 Szczesny et al. .
4,641,902 2/1987 Fusselman .
4,644,993 2/1987 Cooper et al. .
4,647,132 3/1987 Mikola .
4,652,969 3/1987 Stegenga .
4,664,462 5/1987 Owens .
4,669,801 6/1987 Worth .
4,671,540 6/1987 Medvick et al. .
4,679,118 7/1987 Johnson et al. ..... 439/487 X
4,685,490 8/1987 Medvick et al. .
4,689,723 8/1987 Myers et al. ..... 439/607 X
4,690,477 9/1987 Doutrich et al. ..... 439/595
4,693,533 9/1987 Szczesny et al. ..... 439/350
4,695,111 9/1987 Grabbe et al. ..... 439/226
4,695,113 9/1987 Eckhaus ..... 439/404
4,697,832 10/1987 Dickirson .
4,702,504 10/1987 Brothers .

(List continued on next page.)

U.S. PATENT DOCUMENTS

| | | | |
|---|---|---|---|
| 4,709,302 | 11/1987 | Jordan et al. | 361/388 |
| 4,713,013 | 12/1987 | Regnier et al. | 439/326 X |
| 4,717,344 | 1/1988 | Schempp et al. | 439/61 |
| 4,721,348 | 1/1988 | Mouissie | 439/328 |
| 4,722,700 | 2/1988 | Kuhn et al. | 439/629 |
| 4,722,750 | 2/1988 | Saito et al. . | |
| 4,725,250 | 2/1988 | Kuhn et al. | 439/629 |
| 4,726,783 | 2/1988 | Nakazawa et al. | 439/350 |
| 4,735,583 | 4/1988 | Rudy, Jr. et al. | 439/350 |
| 4,737,120 | 4/1988 | Grabbe et al. | 439/326 |
| 4,756,694 | 7/1988 | Billman et al. | 439/61 |
| 4,761,140 | 8/1988 | Geib | 439/71 |
| 4,762,505 | 8/1988 | Asick et al. | 439/347 |
| 4,781,612 | 11/1988 | Thrush | 439/630 X |
| 4,781,628 | 11/1988 | Detter et al. | 439/748 |
| 4,782,289 | 11/1988 | Schwar et al. | 324/58 F |
| 4,787,858 | 11/1988 | Killian, Jr. | 439/350 |
| 4,789,848 | 12/1988 | Castonguay et al. . | |
| 4,806,105 | 2/1989 | Muzslay | 439/74 |
| 4,822,303 | 4/1989 | Nakamura et al. | 439/607 |
| 4,826,446 | 5/1989 | Juntwait | 439/326 |
| 4,831,727 | 5/1989 | Johnson, Jr. et al. | 29/866 |
| 4,832,614 | 5/1989 | Jenkins | 439/188 |
| 4,838,808 | 6/1989 | Fujiura | 439/357 |
| 4,838,811 | 6/1989 | Nakamura et al. | 439/607 |
| 4,850,891 | 7/1989 | Walkup et al. | 439/326 |
| 4,850,892 | 7/1989 | Clayton et al. | 439/326 |
| 4,857,008 | 8/1989 | Kee et al. | 439/352 |
| 4,859,203 | 8/1989 | Eckhaus | 439/404 |
| 4,864,263 | 9/1989 | Castonguay et al. | 29/622 X |
| 4,869,689 | 9/1989 | Angerer | 439/616 |
| 4,872,853 | 10/1989 | Webster | 439/327 |
| 4,887,182 | 12/1989 | Sweet | 361/117 |
| 4,895,473 | 1/1990 | Hennick | 403/191 |
| 4,897,040 | 1/1990 | Gerke et al. | 439/901 |
| 4,898,540 | 2/1990 | Saito | 439/153 |
| 4,906,208 | 3/1990 | Nakamura et al. | 439/607 |
| 4,924,340 | 5/1990 | Sweet | 361/56 |
| 4,928,199 | 5/1990 | Diaz et al. | 361/56 |
| 4,929,194 | 5/1990 | Korsunsky et al. | 439/571 |
| 4,932,891 | 6/1990 | Spanke et al. | 439/395 |
| 4,936,795 | 6/1990 | Kawai et al. | 439/609 |
| 4,941,849 | 7/1990 | Fujiura | 439/610 |
| 4,952,173 | 8/1990 | Peronnet et al. | 439/853 |
| 4,961,711 | 10/1990 | Fujiura et al. | 439/357 |
| 4,986,765 | 1/1991 | Korsansky et al. | 439/326 |
| 4,995,830 | 2/1991 | Eckhaus | 439/409 |
| 5,015,196 | 5/1991 | Yamada | 439/326 |

FOREIGN PATENT DOCUMENTS

| | | |
|---|---|---|
| 2258760 | 8/1975 | France . |
| 2305912 | 10/1976 | France . |
| 0277873 | 8/1988 | France . |
| 55-120193 | 8/1980 | Japan . |
| 56-8090 | 1/1981 | Japan . |
| 60-22765 | 2/1985 | Japan . |
| 60-113692 | 8/1985 | Japan . |
| 61-26295 | 2/1986 | Japan . |
| 61-44875 | 3/1986 | Japan . |
| 61-65678 | 5/1986 | Japan . |
| 61-76683 | 5/1986 | Japan . |
| 61-129286 | 8/1986 | Japan . |
| 61-158079 | 9/1986 | Japan . |
| 62-246277 | 10/1987 | Japan . |
| 62-201468 | 12/1987 | Japan . |
| 63-120368 | 8/1988 | Japan . |
| 63-137477 | 9/1988 | Japan . |
| 63-304585 | 12/1988 | Japan . |
| 64-10977 | 1/1989 | Japan . |
| 64-10986 | 1/1989 | Japan . |
| 64-22071 | 2/1989 | Japan . |
| 1-260772 | 10/1989 | Japan . |

OTHER PUBLICATIONS

"Spring Retainer For Retention of Cable Connector", G. E. Meyer, IBM Technical Disclosure Bulletin, vol. 20, No. 5, Oct. 1977.

"Eighth Annual Connector Symposium Proceedings," Electrical Connector Study Group, Inc., Oct. 1975.

"A Second Generation IDC Interface," R. Barry, Proceedings National Electronic Packaging and Production Conference, Feb., Mar. and May 1978.

"Celanex Thermoplastic Polyester Bulletin J1A Properties & Processing," Celanese Engineering Resins, Feb. 1984.

Japanese Utility Models listed in Computer Search Report of Apr. 13, 1991.

Japanese Patents listed in Computer Search Report of Apr. 13, 1991.

"Designing With Plastic, The Fundamentals," Hoechst Celanese Corporation, Engineering Plastics Division Advanced Materials Group, Date Unknown.

Molex SIMM Socket Brochure, Date Unknown.

Molex SIMM Socket Technology Handbook, Date Unknonw.

Augat 3900 Series SIMM Socket Brochure, Date Unknown.

European Search Report, RS 85227 U.S.

Declaration of Roger L. Thrush.

INSERTABLE LATCH MEANS FOR USE IN AN ELECTRICAL CONNECTOR

This application is a continuation of application Ser. No. 07/645,151, filed Jan. 22, 1991, abandoned, which is a continuation of application Ser. No. 07/313,261, filed Feb. 21, 1989, U.S. Pat. No. 4,986,765.

FIELD OF THE INVENTION

The invention is directed to a latch means for use in an electrical connector. In particular, the latch means are insertable into a housing of the connector to cooperate with respective circuit boards, the latch means being configured to accommodate the wide tolerance range associated with the circuit boards.

BACKGROUND OF THE INVENTION

Many electrical connectors are known which provide electrical connection between contact surfaces of a daughter board and contact areas of a mother board. In general, the connector has contacts positioned therein which extend from a first mating surface of the connector to a second mating surface. The contacts have posts which extend from the connector and make electrical engagement with the contact areas of the mother board. The daughter board is then inserted into the connector and rotated to its operating position. As this rotation occurs, contact projections of the contacts engage the contact surfaces of the daughter board. In order for this electrical engagement to be maintained, it is essential that latch arms be provided to cooperate and maintain the daughter board in the operational position.

An example of this type of electrical connector is described in U.S. Pat. No. 4,737,120. As is shown in FIG. 1 of that patent, the latch members are provided at the ends of the connector, and are integrally molded with the housing. The configuration of the latch members provides the latch members with the resilient characteristics required in order to allow the latch members to cooperate with the daughter board to maintain the daughter board in electrical engagement with the terminals of the connector.

However, several problems are associated with the configuration of the latch member described above. As the latch members are molded from plastic material, and as the resilient characteristics of plastic is not significant, the latch members are likely to take a permanent set, particularly when the connector is used over many cycles. This likelihood is increased due to the fact that the latch members must have a relatively thin width when molded. This requirement reduces the durability of the latch members, so that the latch members are only strong enough to support approximately 25 cycles (insertions and removals of the printed circuit board). Consequently, if the electrical connector is to be used over many cycles, the risk of failure of the electrical connector is greatly increased.

It is also important to note that a relatively small displacement of the molded latch is enough to cause the latch to take a permanent set Consequently, as the daughter board can vary in size, and still fall within the tolerance limits for the connector, it is possible that a relatively large board will be inserted into the slots, and then be followed by a relatively small board. The insertion of the large board into the slot can cause the plastic latch to take a permanent set, so that as the small board is inserted, the latch will not be effective in maintaining the board in the slot, resulting in an ineffective connector.

It would therefore be advantageous if the latch members could be made from a material having the desired resilient characteristics. This requires the latch members to be separately manufactured and inserted into the housing after the housing has been molded.

Another problem associated with the connector disclosed in U.S. Pat. No. 4,737,120, and other similar connectors, relates to the mounting posts. Generally, mounting posts cooperate with openings in the mother board to position and maintain the connector and terminals in place until soldering or the like occurs. However, it is important to note, that the dimensions of the posts must be minimized, as the space available on printed circuit boards is at a premium. Consequently, the width of the posts must be held to a minimum in order for the connector to occupy a minimal amount of board real estate. This miniaturization of the post causes the post to be relatively weak, particularly because the post is manufactured from molded plastic. Therefore, as the post is relatively weak, it is possible that damage will occur to the post during the shipping of the connector, thereby resulting in an ineffective connector.

It would therefore be advantageous if the post could be strengthened without the need to increase the area which the post occupies. The utilization of this type of post would require the post to be attached to the connector in some manner, as the post would no longer be able to be molded at the same time as the housing of the connector.

SUMMARY OF THE INVENTION

The invention is directed to an electrical connector which has an improved latch member provided at each end thereof. One embodiment of the latch member has an integral mounting post which extends beyond the connector to cooperate with the mother board. The latch members are constructed from a material which has the resilient and strength characteristics required to insure for effective operation over many cycles. It is also possible to provide the latch members with adequate electrical properties, so that the latch members may be used to supply power from the mother board to the daughter board.

An insertable latch member is described for use in an electrical connector. The electrical connector has a housing with a first major surface and an oppositely facing second major surface. A daughter or baby board receiving recess or slot extends from the first major surface toward the second major surface. Contact terminals are provided adjacent to the baby board receiving recess and extend from the baby board receiving recess to beyond the second major surface. Latch receiving recesses are provided adjacent to the baby board receiving recess, and are dimensioned to receive the latch member therein.

One embodiment of the latch member has a resilient section and mounting section which is integrally attached to the resilient section. The resilient section has a resilient arm which extends from a base portion of the resilient section. A free end of the resilient arm is formed to provide a projection which extends in a direction which is essentially perpendicular to the longitudinal axis of the resilient arm. The mounting section extends from the base portion of the resilient section, and is dimensioned to be received in an aperture of a printed circuit board. The resilient section and the mounting section form an electrically conductive pathway across which electrical signals are conducted.

DETAILED DESCRIPTION OF THE INVENTION

Figure 1:
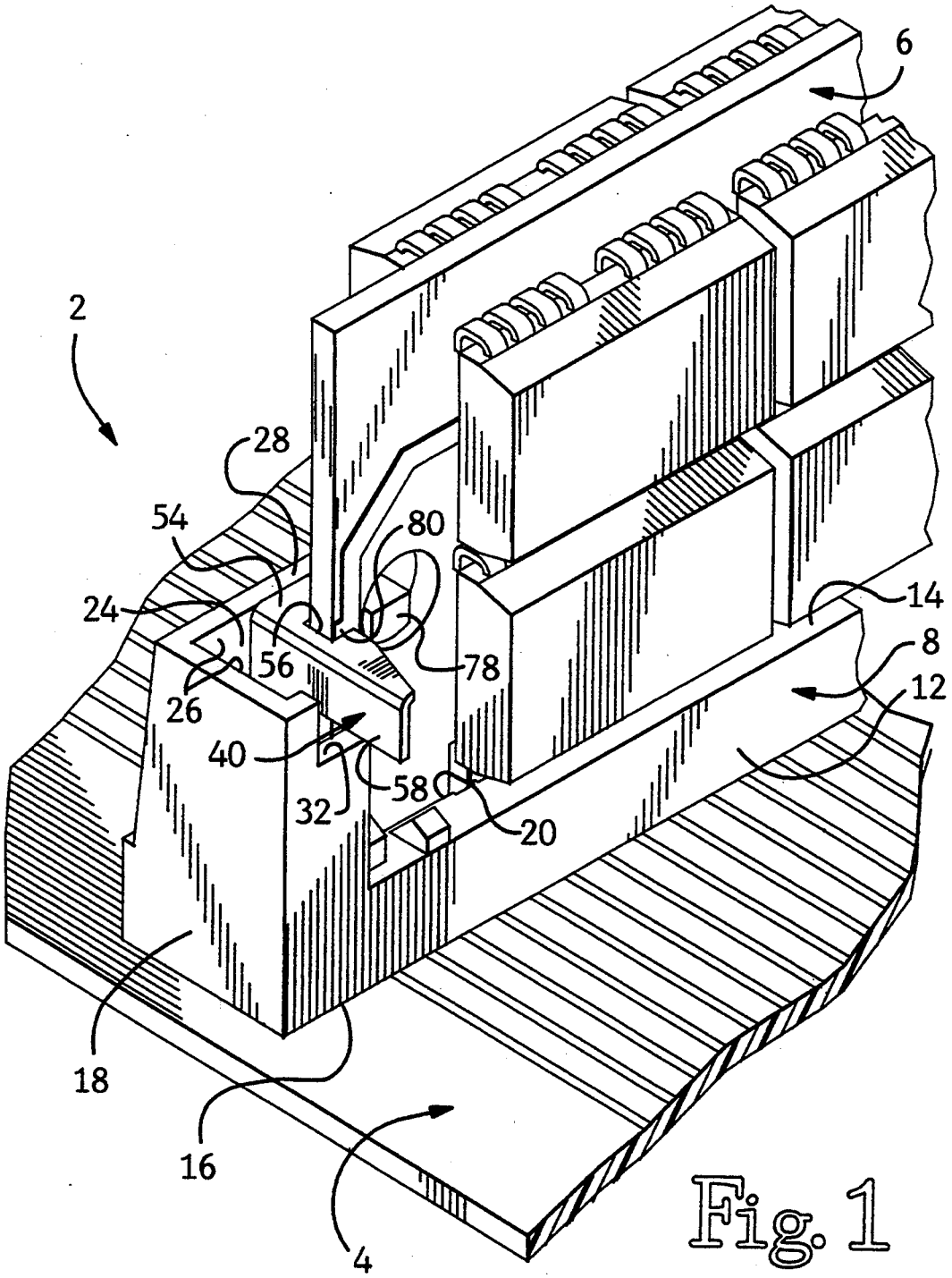
FIG. 1 is a perspective view of a connector with an insertable latch member provided therein, the connector electrically connects a mother board with a daughter card.
Figure 2:
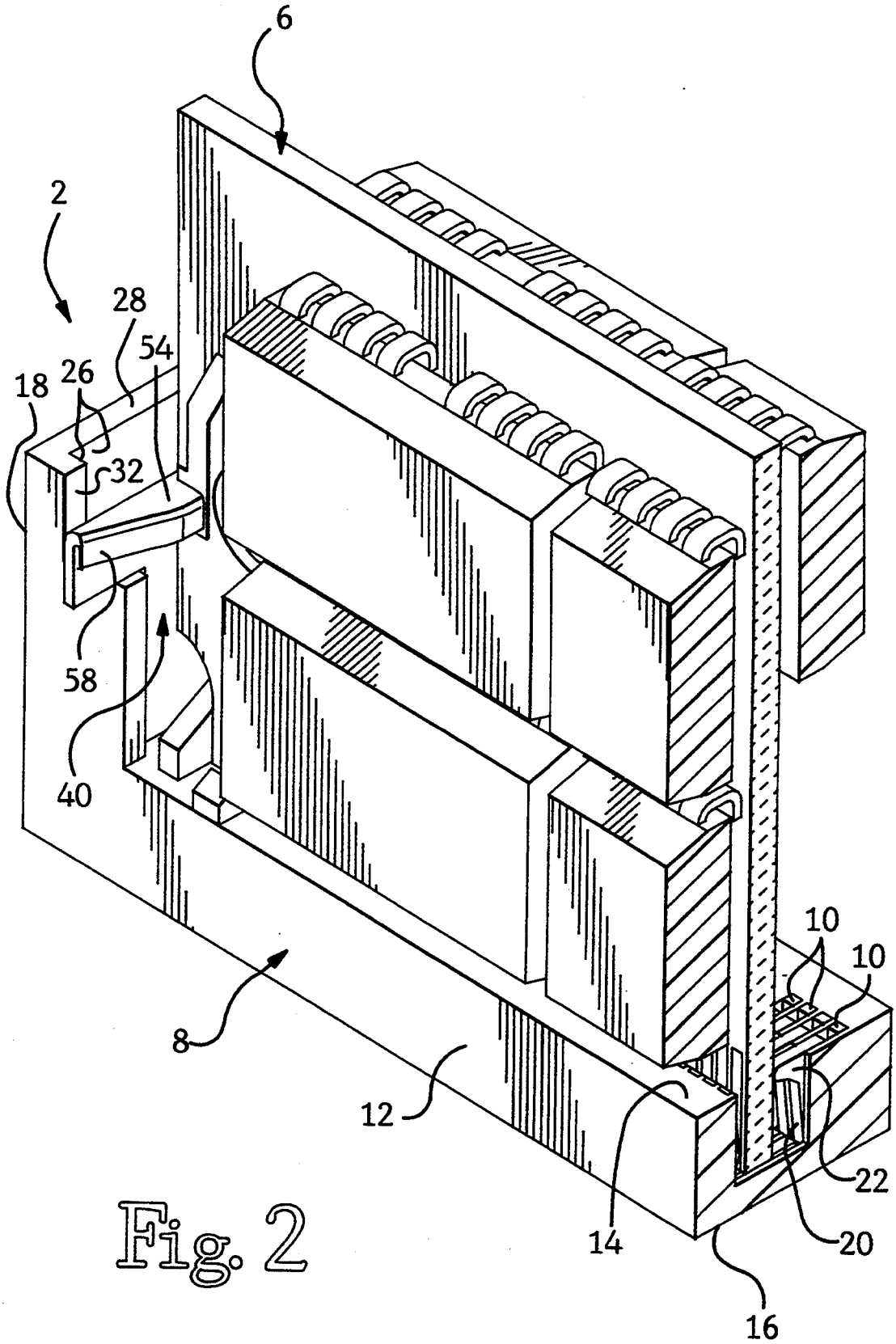
FIG. 2 is a perspective view of the connector, showing the cooperation of the latch member with the daughter card.

Referring to FIGS. 1 and 2, there is illustrated a low insertion force electrical connector 2. The connector electrically and mechanically connects printed circuit board 4 to printed circuit board 6.

The connector 2 has an elongated housing 8 having a plurality of contact receiving cavities 10 located in an elongated base 12. The housing is made from any material having the desired dielectric characteristics.

The plurality of contact receiving cavities 10, as shown in FIG. 2, extend from top surface 14 of base 12 to proximate bottom surface 16 of the base. The cavities are provided in spaced apart parallel relationship to each other and to ends 18 of base 8. The cavities are in communication with a board-receiving opening 20. The exact shape of the cavities 10 varies according to the shape of contacts 22 to be secured therein.

Contacts 22 are disposed in cavities 10. Each contact is made from sheet metal stock having the desired conductive and resilient characteristics. A more detailed explanation of a particular type of contact which can be used in the connector is more fully disclosed in U.S. Pat. No. 4,737,120, which is hereby incorporated by reference.

Figure 3:
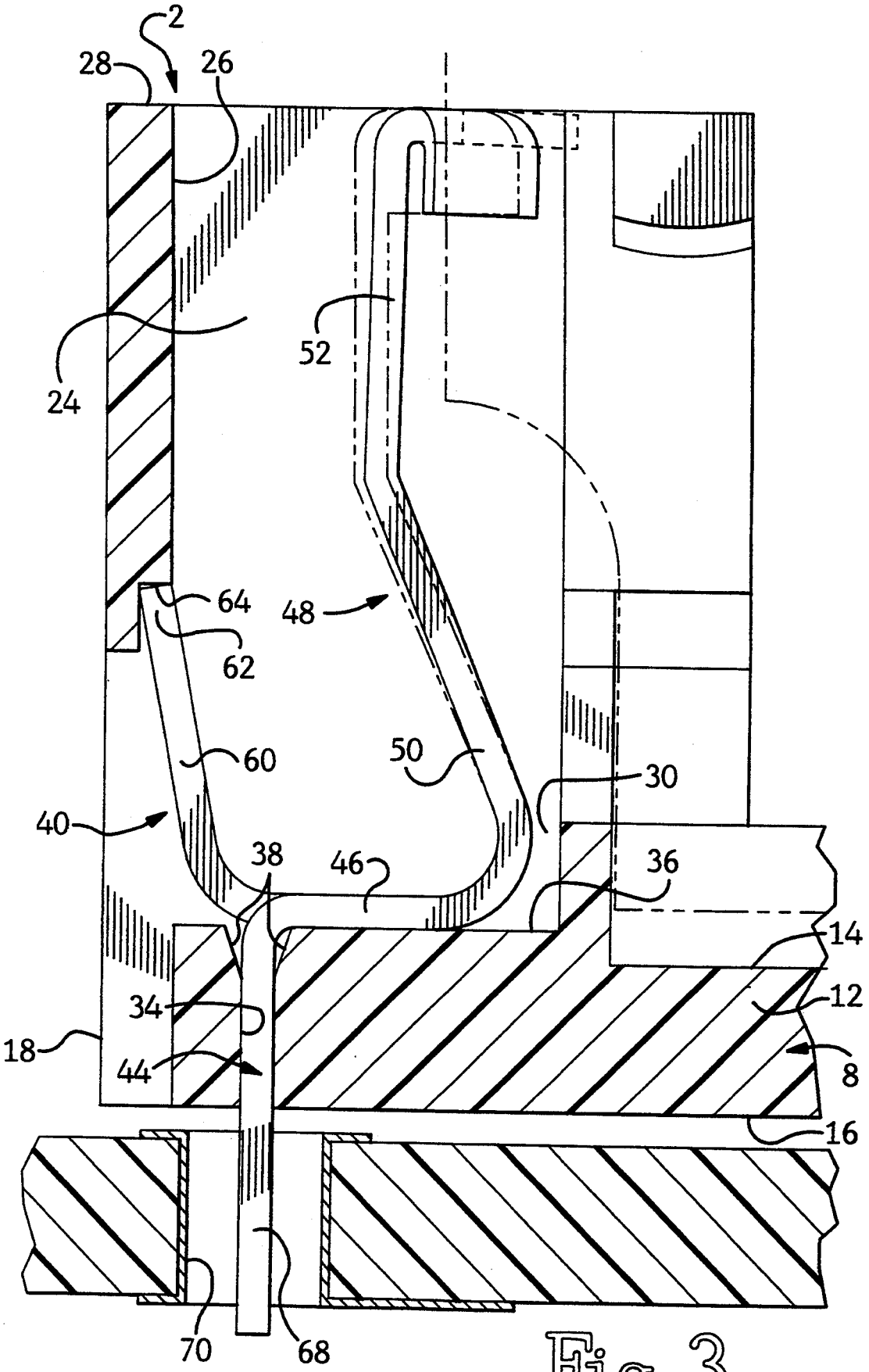
FIG. 3 is a cross-sectional view of an end portion of the connector, showing the latch member provided in a latch receiving recesses, the motion of the latch member as the daughter card is inserted into the connector is indicated by the lines shown in phantom.

Proximate ends 18 of base 8 are latch receiving recesses 24, as best shown in FIGS. 1 through 3. Each latch receiving recess 24 is provided proximate the board-receiving opening 20. As is shown in FIGS. 1 and 2, each latch receiving recess 24 has three side walls 26 which extend from an upper surface 28 of the connector housing toward the bottom surface 16 of the base. As shown in FIGS. 1 and 2, a recess 32 is provided in one of the side walls 26, the recess extending from the upper surface 28 of the housing toward the top surface 14 of the base 8. The fourth side wall 30 (FIG. 3), which is positioned adjacent the board-receiving opening 20, does not extend to the upper surface 28 of the housing.

Post receiving openings 34 extend from the bottom surface 16 of base 8 to the bottom walls 36 of recesses 24. As is shown in FIG. 3, post receiving openings 34 have lead-in surfaces 38 provided proximate the bottom walls 36 of the recesses 24.

Figure 6:
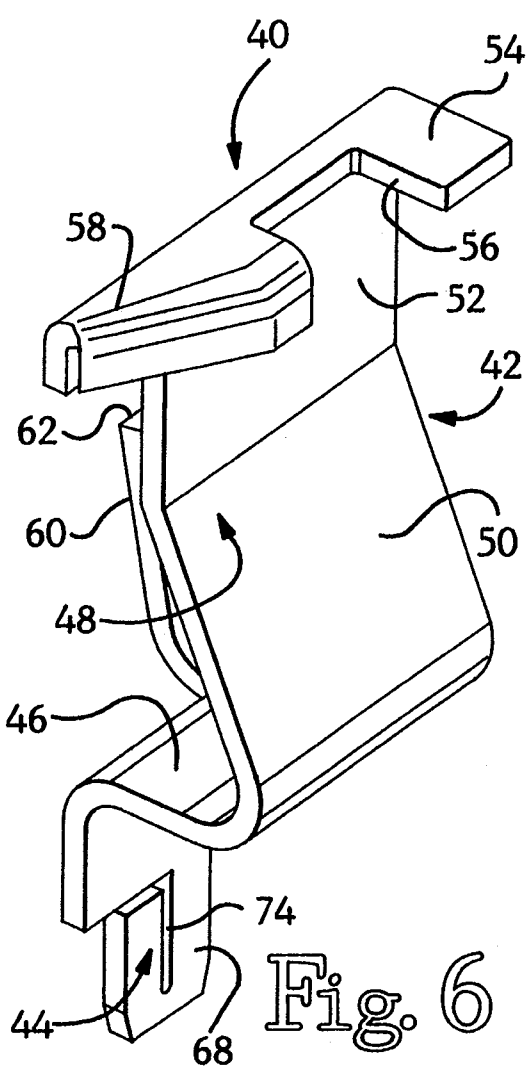
FIG. 5 and 6 are perspective views of the latch member removed from the latch receiving recess, these views differ from FIG. 4 only in the angle at which the latch member is viewed.
Figure 4:
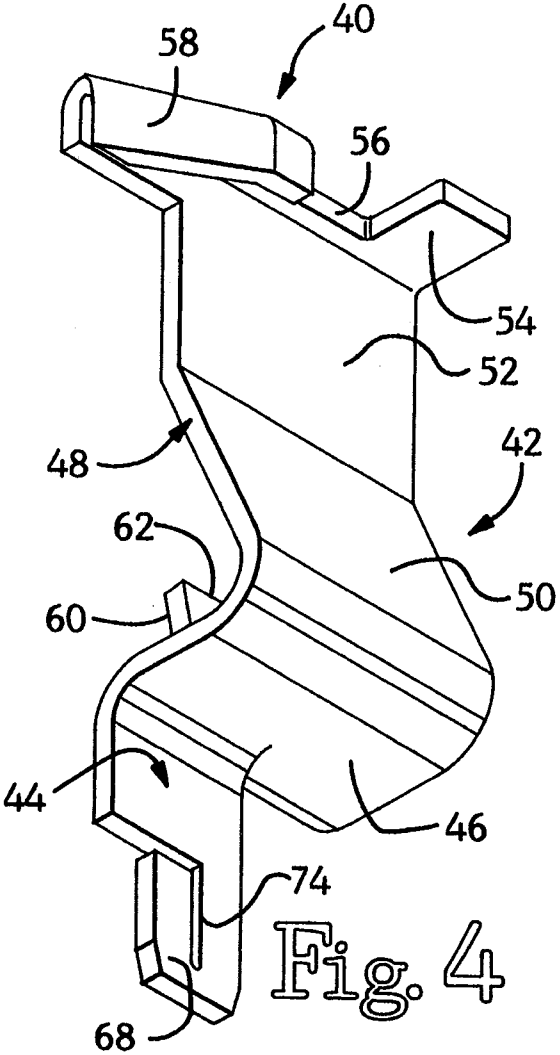
FIG. 4 is a perspective view of the latch member removed from the latch receiving recess of the connector.
Figure 7:
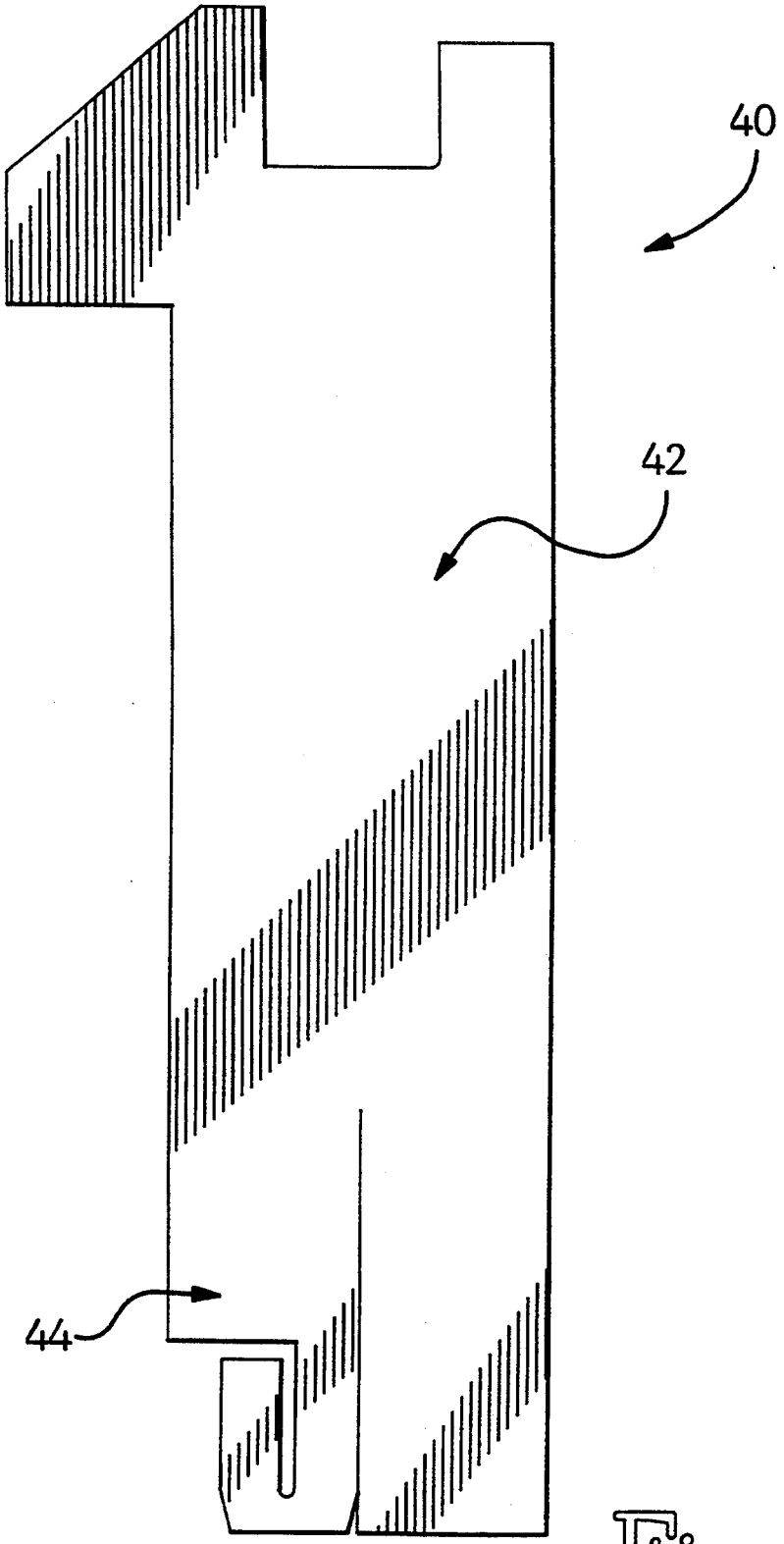
FIG. 7 is a plan view of a sheet metal blank from which the latch member is formed.

Latch members 40 are positioned in the latch receiving recesses 24. As is shown in FIG. 7, each latch member is stamped from sheet metal stock having the desired resilient and electrical characteristics. The latch members are then formed into the configuration shown in FIGS. 4 through 6.

Figure 5:
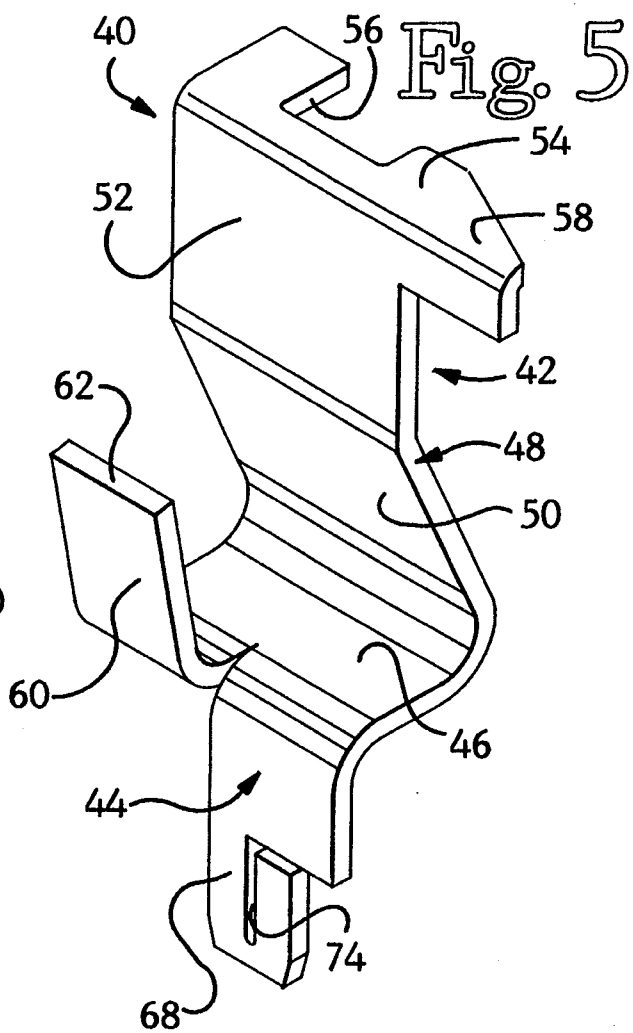

For ease of explanation and understanding, only one latch member 40 will be described in detail. However, it is important to note that in most applications, more than one latch member will be used in a connector. As shown in FIG. 5 each latch member 40 has a resilient section 42 and a mounting section 44. The resilient section 40 has a base portion 46 which has two ends provided thereon. Extending from a first end of the base portion 46 is resilient arm 48. The resilient arm has an angled portion 50 which extends at an angle from the free end of the base portion 46. An intermediate portion 52 extends from an end of the angled portion 50 in a direction which is essentially perpendicular to the base portion 46.

A latch projection 54 is provided at the upper surface of the intermediate portion 52. The latch projection 54 extends from the intermediate portion 52, in a direction which is essentially perpendicular to the intermediate portion. A board edge receiving opening or channel 56 is provided in the latch projection 54 to allow the daughter board to be inserted therein, as will be more fully described.

An engagement projection 58 extends from a side edge of the intermediate portion 52 and from an edge surface of the latch projection 54. As shown in FIGS. 1 and 2, the engagement projection 58 extends beyond the housing of the connector, thereby allowing a technician to engage the engagement projection 58.

The general configuration of the resilient arm 48 of the latch member 40 provides the resilient characteristics required to insure for the proper and continued use of the latch member over many cycles. However, other configurations of the resilient arms are possible. In fact, it is conceivable that due to space considerations, each latch member provided in the connector may have a slightly different appearance. The operation of the each latch member, no matter the configuration, is essentially identical to the operation of the latch member described herein.

A securing arm 60 is provided at a second end of base portion 46. As best shown in FIG. 3, securing arm 60 extends from the base portion 46 towards the upper surface 28 of the connector housing, in essentially the same direction as the angled portion 50 of resilient arm 48. A free end 62 of securing arm 60cooperates with a shoulder 64 provided on one of the side walls 26 of the latch receiving recess 24. It should be noted that the configuration of the securing arm and the shoulder of the side wall allows the latch member 40 to be inserted into the latch member receiving recess 24 through the upper surface 28 of the connector housing. As insertion occurs, securing arm 60 will be caused to move to the right as viewed in FIG. 3, thereby placing the securing arm in a stressed position. Once the latch member 40 is fully inserted into the recess 24, the free end 62 of the securing arm 60 will be resiliently displaced into the shoulder 64 of the side wall, thereby preventing the removal of the latch member 40 from the latch receiving recess 24. The configuration of the securing arm 60 and the base portion 40 enhance the resilient characteristics of resilient arm 48.

Referring back to FIG. 5, mounting section 44 extends from the second end of base portion 46, in a direction toward the bottom surface 16 of the base of the connector. It should be noted that the width of the securing arm 60 plus the width of the mounting section 44 is equal to the width of the base portion 46, as best shown in FIG. 7.

Mounting section 44 extends beyond the bottom surface 16 of the base 12 to cooperate with a printed circuit board (mother board) 4. A board engagement portion 68 is provided on the mounting section 44 to insure that the latch member will be provided in engagement with an opening 70 provided in the printed circuit board 4. The width of portion 68 is slightly larger than the width of a corresponding opening 70 in the printed circuit board. Consequently, as the portion 68 is inserted into the opening 70, the portion 68 is allowed to deform due to the presence of slot 74. This deformation allows the board engagement portion 68 to be inserted into the opening 70. This type of deformation causes portion 68 to exert a force on the walls of the opening when the portion 68 is properly inserted therein, thereby insuring that the portion 68 will be maintained in the opening 70.

With the connector secured to printed circuit board 4, a daughter card 6 is positioned in the board-receiving opening 20 at an angle. The daughter card 6 must then be rotated to the position shown in FIGS. 1 and 2. As this rotation occurs, the daughter card 6 engages the latching projection 54. This causes the resilient arm 48 to be moved toward the end 18 of the connector, as indicated by the lines drawn in phantom in FIG. 3. The resilient deformation of the resilient arm allows the daughter card 6 to continue its turning motion. When the card is essentially perpendicular to printed circuit board 4, the daughter card 6 enters the board edge receiving opening 56, thereby disengaging the projections, allowing the resilient arm to snap back in place. The daughter card is now secured in position between the latching projection 54 and stop member 78 provided on the housing.

To remove the daughter card 6 from the connector, the technician engages the engagement projection 58 and moves the projection toward end 18. This causes the resilient arm 48 to be moved to the position indicated by the lines drawn in phantom in FIG. 3, thereby allowing the daughter card 6 to be rotated in the opposite direction of that previously described.

Several advantages are provided by the type of latch member 40 described herein. Due to the fact that the latch member 40 is insertable into the housing, and therefore is not molded from the same plastic material as the housing, the latch member 40 is usable over many more cycles. The material from which the latch member 40 is manufactured can be chosen to maximize the resilient and strength characteristics of the resilient arm 48. Consequently, as daughter boards are inserted and removed, each resilient arm 48 will not take a permanent set, and will therefore be usable over a great number of cycles.

Also, because of the enhanced characteristics of the latch member 40, the resilient arm 48 is capable of accommodating a wider range of card widths. This is an important advantage, as the tolerance limits associated with the daughter cards 6 can be significant. In the prior art, when a relatively wide card was inserted into the connector, it would cause the plastic latches to take a permanent set. Consequently, when a relatively small card was inserted, the latches could not retain the card in position. With the present invention this result is eliminated, as the latch members 40 will not take a permanent set due to the varied dimensions of the cards.

In the prior art, if the latch is damaged, the entire connector must be replaced. This can be a costly proposition, as all the contacts, etc. in the connectors are discarded. However, in the present invention, if the latch members are damaged, only the latch member 40 need be replaced. Consequently, the remaining portion of the connector is salvaged.

Another advantage of this embodiment of the latch member 40 relates to the strength characteristics of the mounting section 44. In prior art connectors, in which the mounting posts are molded from the same material as the housing, the posts are inherently weak. Consequently, the failure of the post during shipping or insertion resulted in a major problem, as the failure of the post caused the entire connector being ineffective. However, in the present invention, the mounting section 44 is made from a material having significant strength characteristics. Therefore, damage to the mounting section during shipping and insertion is essentially eliminated, resulting in a much more reliable connector.

Another advantage of the embodiment of the latch member 40 described herein is directed to the electrical characteristics which are provided. In this age of miniaturization, when board real estate is at a premium, it is essential that connectors occupy minimal space. It is therefore important that the contact terminals provided in the connector be as few as possible. In an attempt to achieve this result, it is extremely beneficial to provide contact terminals which only transmit communication signals thereacross. In other words, the power and ground transmissions are provided by other means. In the described embodiment of the present invention, due to the electrical characteristics of the latch members 40, the power and ground can be supplied from the printed circuit board 4 to the daughter card 6 through the latch members. The power is supplied from board 4 by way of opening 70. Board engagement section 68 is provided in electrical engagement with the opening, such that the power signals are transmitted from board 4 to latch member 40, which is comprised of electrically conductive material. The power signals are supplied to the daughter card 6 by means of the electrical connection provided between the latch projections 54 and conductive areas 80 of the daughter card 6, as shown in FIGS. 1 and 2. It should be noted that in order to provide for the electrical engagement required between the daughter card and the latch member, the board edge receiving recess with which the daughter card cooperates must be precisely dimensioned.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

We claim:

1. An electrical connector for connecting a daughter card and a mother board, the daughter card being rotatable relative to the mother board between a first and a second position, the electrical connector having a housing with a card receiving slot dimensioned to receive the daughter card therein, and the connector having contact terminals positioned adjacent to the card receiving slot and configured to make an electrical connection with the daughter card when the daughter card is in the second position in the card receiving slot, the electrical connector comprising:

a latch receiving recess provided at an end of the housing near the card receiving slot of the housing;

a separate resilient latch having a base portion which is positioned in the latch receiving recess, and a latching portion which extends from the latch receiving recess toward the card receiving slot;

whereby after the daughter card is rotated from the first position to the second position, the latch cooperates with the daughter card to maintain the daughter card in the second position.

2. An electrical connector as recited in claim 1 wherein the latch is a metal member.

3. An electrical connector as recited in claim 2 wherein the latch has a mother board cooperating portion extending from the base portion of the latch through the housing to make electrical connection with the mother board, such that an electrical pathway is established through the latch between the mother board and the daughter card when the daughter card is in the second position.

4. An electrical connector as recited in claim 2 wherein the latching portion is positioned outside of the latch receiving recess, and extends toward the card receiving slot.

5. An electrical connector as recited in claim 4 wherein the latching portion has an engagement section with a lead-in surface provided thereon, such that as the daughter card is rotated from the first position to the second position, the daughter card will engage the lead-in surface, causing a resilient arm of the resilient latch to be cammed away from the card receiving slot, thereby allowing for the continued rotation of the daughter card to the second position.

6. An electrical connector as recited in claim 5 wherein the latching portion is provided with a card-edge receiving channel such that after the daughter card is rotated to the second position, the card-edge receiving channel will cooperate with the daughter card to secure the daughter card in the second position.

7. An electrical connector as recited in claim 2 wherein the latch receiving recess is defined by a base and at least one wall.

8. An electrical connector as recited in claim 7 wherein the latch receiving recess is defined by a base and four walls.

9. An electrical connector as recited in claim 2 wherein the latching portion has an engagement section with a lead-in surface provided thereon, such that as the daughter card is rotated from the first position to the second position, the daughter card will engage the lead-in surface, causing resilient arm of the resilient latch to be cammed away from the card receiving slot, thereby allowing for the continued rotation of the daughter card to the second position.

10. An electrical connector as recited in claim 9 wherein the latching portion is provided with a card-edge receiving channel such that after the daughter card is rotated to the second position, the card-edge receiving channel will cooperate with the daughter card to secure the daughter card in the second position.

11. An electrical connector as recited in claim 2 wherein the base portion of the latch has a securing arm and a resilient arm connected by a curved portion, the securing arm engaging the housing at a location above the curved portion, such that as the daughter card is rotated between the first position and the second position, the resilient arm is deflected with respect to the securing arm.

12. An electrical connector as recited in claim 11 wherein the latching portion [of the latch]is positioned outside of the latch receiving recess, and extends toward the card receiving slot.

13. An electrical connector as recited in claim 12 wherein the latching portion has an engagement section with a lead-in surface provided thereon, such that as the daughter card is rotated from the first position to the second position, the daughter card will engage the lead-in surface, causing resilient arm of the resilient latch to be cammed away from the card receiving slot, thereby allowing for the continued rotation of the daughter card to the second position.

14. An electrical connector as recited in claim 13 wherein the latching portion is provided with a card-edge receiving channel such that after the daughter card is rotated to the second position, the card-edge receiving channel will cooperate with the daughter card to secure the daughter card in the second position.

15. An electrical connector as recited in claim 11 wherein the latching portion has an engagement section with a lead-in surface provided thereon, such that as the daughter card is rotated from the first position to the second position, the daughter card will engage the lead-in surface, causing resilient arm of the resilient latch to be cammed away from the card receiving slot, thereby allowing for the continued rotation of the daughter card to the second position.

16. An electrical connector as recited in claim 15 wherein the latching portion is provided with a card-edge receiving channel such that after the daughter card is rotated to the second position, the card-edge receiving channel will cooperate with the daughter card to secure the daughter card in the second position.

17. An electrical connector for connecting a daughter card and a mother board, the daughter card being rotatable relative to the mother board between a first and a second position, the electrical connector having a housing with a card receiving slot dimensioned to receive the daughter card therein, and the connector having contact terminals positioned adjacent to the card receiving slot and configured to make an electrical connection with the daughter card when the daughter card is in the second position in the card receiving slot, the electrical connector comprising:

a latch receiving section provided near an end of the housing adjacent the card receiving slot of the housing;

a separate resilient latch having a base portion which is positioned in the latch receiving section, and a latching portion which extends from the latch receiving section toward the card receiving slot, the latch positioned in the latch receiving section such that the latch receiving section cooperates with the latch to limit movement of the latching portion in a direction transverse to the length of the card receiving slot;

whereby after the daughter card is rotated from the first position to the second position, the latch cooperates with the daughter card to maintain the daughter card in the second position.

18. An electrical connector as recited in claim 17 wherein the latch is a metal member.

19. An electrical connector as recited in claim 18 wherein the latch has a mother board cooperating portion extending from the base portion of the latch through the housing to make electrical connection with the mother board, such that an electrical pathway is established through the latch between the mother board and the daughter card when the daughter card is in the second position.

20. An electrical connector as recited in claim 18 wherein the latching portion of the latch is positioned outside of the latch receiving section, and extends toward the card receiving slot of the housing.

21. An electrical connector as recited in claim 20 wherein the latching portion has an engagement section with a lead-in surface provided thereon, such that as the daughter card is rotated from the first position to the second position, the daughter card will engage the lead-in surface, causing resilient arm of the resilient latch to be cammed away from the card receiving slot, thereby allowing for the continued rotation of the daughter card to the second position.

22. An electrical connector as recited in claim 21 wherein the latching portion is provided with a card-edge receiving channel such that after the daughter card is rotated to the second position, the card-edge receiving channel will cooperate with the daughter card to secure the daughter card in the second position.

23. An electrical connector as recited in claim 18 wherein the latching portion has an engagement section with a lead-in surface provided thereon, such that as the daughter card is rotated from the first position to the second position, the daughter card will engage the lead-in surface, causing resilient arm of the resilient latch to be cammed away from the card receiving slot, thereby allowing for the continued rotation of the daughter card to the second position.

24. An electrical connector as recited in claim 23 wherein the latching portion is provided with a card-edge receiving channel such that after the daughter card is rotated to the second position, the card-edge receiving channel will cooperate with the daughter card to secure the daughter card in the second position.

25. An electrical connector as recited in claim 18 wherein the base portion of the latch has a securing arm and a resilient arm connected by a curved portion, the securing arm engaging the housing at a location above the curved portion, such that as the daughter card is rotated between the first position and the second position, the resilient arm is deflected with respect to the securing arm.

26. An electrical connector as recited in claim 25 wherein the latching portion has an engagement section with a lead-in surface provided thereon, such that as the daughter card is rotated from the first position to the second position, the daughter card will engage the lead-in surface, causing a resilient arm of the resilient latch to be cammed away from the card receiving slot, thereby allowing for the continued rotation of the daughter card to the second position.

27. An electrical connector as recited in claim 26 wherein the latching portion is provided with a card-edge receiving channel such that after the daughter card is rotated to the second position, the card-edge receiving channel will cooperate with the daughter card to secure the daughter card in the second position.

28. An electrical connector as recited in claim 25 wherein the latching portion has an engagement section with a lead-in surface provided thereon, such that as the daughter card is rotated from the first position to the second position, the daughter card will engage the lead-in surface, causing resilient arm of the resilient latch to be cammed away from the card receiving slot, thereby allowing for the continued rotation of the daughter card to the second position.

29. An electrical connector as recited in claim 28 wherein the latching portion is provided with a card-edge receiving channel such that after the daughter card is rotated to the second position, the card-edge receiving channel will cooperate with the daughter card to secure the daughter card in the second position.

30. An electrical connector as recited in claim 17 wherein the latch receiving section includes a base and at least one wall.

31. An electrical connector as recited in claim 30 wherein the latch receiving section includes a recess defined by a base and four walls.

32. An electrical connector for connecting a first printed circuit board to a second printed circuit board, the electrical connector comprising:

a housing of dielectric material, mountable on the first printed circuit board, the housing including a base having a slot for receiving the second printed circuit board;

a latch receiving recess adjacent at least one end of the board-receiving slot; and a separate resilient latch positioned in said latch receiving recess, said latch having two arms extending upwardly from a base portion, one of said arms engaging the housing to retain the latch on the housing and the other of said arms including a latch projection extending towards the board-receiving slot, the latch projection extending in a direction such that engagement between the latch projection and the second printed circuit board, during rotation of the second printed circuit board into the housing from a first position to a second position, causes one arm to be deflected with respect to the other.

33. An electrical connector as recited in claim 32 wherein the separate resilient latch is a metal member.

34. An electrical connector as recited in claim 33 wherein the arm engaging the housing is positioned in the latch receiving recess and the arm having the latch projection includes a latching section and a releasing section.

35. An electrical connector as recited in claim 34 wherein the latching section has a printed circuit board receiving channel and the releasing section has a lead-in surface, whereby the second printed circuit board is released from the second position by a force applied to the releasing section, thereby causing the arms to be deflected with respect to one another, allowing the second printed circuit board to be rotated back toward the first position.

36. An electrical connector for connecting a first printed circuit board to a second printed circuit board, the electrical connector comprising:

a housing of dielectric material, mountable on the first printed circuit board, the housing including a base having a slot for receiving the second printed circuit board;

a plurality of contact positions in the base adjacent the slot for establishing an electrical interconnection to the second printed circuit board; and a metal latch positioned near the slot, the latch having a pair of arms, one of the arms securing the latch to the housing, and the other of the arms having a latch projection extending in a direction such that engagement between the latch projection and the second printed circuit board, during rotation of the second printed circuit board into the housing, causes the other arm to be resiliently deflected with respect to the securing arm.

37. An edge connector for interconnecting a daughter card and a mother board, the edge connector comprising:

an insulating housing having a plurality of contacts along the length of the insulating housing and separate recess at each end of the insulating housing; and a pair of latches inserted and secured exclusively in the recesses of the insulating housing, each of the latches is made of a metal member having a latching section to latch the daughter card securely to the housing and a releasing section to release the daughter card.

38. An edge connector as recited in claim 37 wherein the latches have base portions positioned in the latch receiving recesses of the housing, and latching portions which extend toward the contacts positioned in the housing, whereby after the daughter card is rotated from a first position to a second position, the latching portions of the latches cooperate with the daughter card to maintain the daughter card in the second position.

39. An edge connector as recited in claim 38 wherein each latch has opposed arms which extend from the base portion, and are deflectable with respect to one another in a resilient fashion.

40. An electrical connector for connecting a daughter card with a mother board, the daughter card being rotatable relative to the mother board between a first and a second position, the electrical connector having a housing with a card receiving slot dimensioned to receive the daughter card therein, and the connector having contact terminals positioned adjacent to the card receiving slot-and configured to make an electrical connection with the daughter card when the daughter card is in the second position in the card receiving slot, the electrical connector comprising:

a latch receiving section provided near an end of the housing and near the card receiving slot of the housing, the section having at least one restraining wall;

a separate resilient metal latch having a curved bottom portion which is positioned in the latch receiving section, and a securing arm and a resilient arm connected to the curved bottom portion and extending upwardly therefrom, the securing arm engaging the housing at a location above the curved bottom portion to position the latch on the housing such that at least one wall of the latch receiving section cooperates with the latch to limit movement of the resilient arm in a direction transverse to the length of the card receiving slot, and the resilient arm including a latch receiving portion which extends from the latch receiving section toward the card receiving slot;

whereby as the daughter card is rotated from the first position to the second position, the resilient arm is deflected with respect to the securing arm, and after the daughter card is in the second position, the latching portion of the resilient arm cooperates with the daughter card to maintain the daughter card in the second position.

41. An electrical connector as recited in claim 40 wherein the latching portion is provided with a card-edge receiving channel such that after the daughter card is rotated to the second position, the card-edge receiving channel will cooperate with the daughter card to secure the daughter card in the second position.

42. An electrical connector as recited in claim 40 wherein the latching portion has an engagement section with an inclined lead-in surface provided thereon, such that as the daughter card is rotated from the first position to the second position, the daughter card will engage the inclined lead-in surface of the engagement section, causing the resilient arm of the resilient latch to be cammed away from the card receiving slot, thereby allowing for the continued rotation of the daughter card to the second position.

43. An electrical connector as recited in claim 42 wherein the latching portion is provided with a card-edge receiving channel such that after the daughter card is rotated to the second position, the card-edge receiving channel will cooperate with the daughter card to secure the daughter card in the second position.

44. An electrical connector for connecting a daughter card and a mother board, the daughter card being rotatable relative to the mother board between a first and a second position, the electrical connector having a housing with a card receiving slot dimensioned to receive the daughter card therein, and the connector having contact terminals positioned adjacent to the card receiving slot and configured to make an electrical connection with the daughter card when the daughter card is in the second position in the card receiving slot, the electrical connector comprising:

a latch receiving section provided near an end of the housing adjacent the card receiving slot of the housing, the section having at least one wall;

a separate resilient latch having a base portion which is positioned in the latch receiving section, and a latching portion which extends from the latch receiving section toward the card receiving slot;

whereby after the daughter card is rotated from the first position to the second position, the latch cooperates with the daughter card to maintain the daughter card in the second position.

45. An electrical connector as recited in claim 44 wherein the latch is a metal member.

46. An electrical connector as recited in claim 44 wherein the latch has a mother board cooperating portion extending from the base portion of the latch through the housing to make electrical connection with the mother board, such that an electrical pathway is established through the latch between the mother board and the daughter card when the daughter card is in the second position.

47. An electrical connector as recited in claim 46 wherein the latching portion has an engagement section with a lead-in surface provided thereon, such that as the daughter card is rotated from the first position to the second position, the daughter card will engage the lead-in surface, causing a resilient arm of the resilient latch to be cammed away from the card receiving slot, thereby allowing for the continued rotation of the daughter card to the second position.

48. An electrical connector as recited in claim 47 wherein the latching portion is provided with a card-edge receiving channel such that after the daughter card is rotated to the second position, the card-edge receiving channel will cooperate with the daughter card to secure the daughter card in the second position.

49. An electrical connector as recited in claim 45 wherein the latching portion has an engagement section with a lead-in surface provided thereon, such that as the daughter card is rotated from the first position to the second position, the daughter card will engage the lead-in surface, causing a resilient arm of the resilient latch to be cammed away from the card receiving slot, thereby allowing for the continued rotation of the daughter card to the second position.

50. An electrical connector as recited in claim 49 wherein the latching portion is provided with a card-edge receiving channel such that after the daughter card is rotated to the second position, the card-edge receiving channel will cooperate with the daughter card to secure the daughter card in the second position.

51. An electrical connector as recited in claim 45 wherein the base portion of the latch has a securing arm and a resilient arm connected by a curved portion, the securing arm engaging the housing at a location above the curved portion, such that as the daughter card is rotated between the first position and the second position, the resilient arm is deflected with respect to the securing arm.

52. An electrical connector as recited in claim 51 wherein the latching portion has an engagement section with a lead-in surface provided thereon, such that as the daughter card is rotated from the first position to the second position, the daughter card will engage the lead-in surface, causing resilient arm of the resilient latch to be cammed away from the card receiving slot, thereby allowing for the continued rotation of the daughter card to the second position.

53. An electrical connector as recited in claim 52 wherein the latching portion is provided with a card-edge receiving channel such that after the daughter card is rotated to the second position, the card-edge receiving channel will cooperate with the daughter card to secure the daughter card in the second position.

54. An electrical connector as recited in claim 51 wherein the latching portion has an engagement section with a lead-in surface provided thereon, such that as the daughter card is rotated from the first position to the second position, the daughter card will engage the lead-in surface, causing resilient arm of the resilient latch to be cammed away from the card receiving slot, thereby allowing for the continued rotation of the daughter card to the second position.

55. An electrical connector as recited in claim 54 wherein the latching portion is provided with a card-edge receiving channel such that after the daughter card is rotated to the second position, the card-edge receiving channel will cooperate with the daughter card to secure the daughter card in the second position.

* * * * *